United States Patent [19]

Boyadjieff et al.

[11] 4,203,182

[45] May 20, 1980

[54] SLIP ASSEMBLY

[75] Inventors: George I. Boyadjieff, Anaheim, Calif.; Jerry A. Gill, Houston, Tex.

[73] Assignee: Varco International, Inc., Orange, Calif.

[21] Appl. No.: 3,293

[22] Filed: Jan. 15, 1979

Related U.S. Application Data

[63] Continuation of Ser. No. 877,309, Feb. 13, 1978, abandoned.

[51] Int. Cl.[2] ..... A44B 21/00

[52] U.S. Cl. ..... 24/263 D

[58] Field of Search ..... 24/263 D, 263 SB, 263 SW, 24/263 CA, 263 DA

[56] References Cited

U.S. PATENT DOCUMENTS

| | | | |
|---|---|---|---|
| 1,676,275 | 7/1928 | Montgomery | 24/263 CA |
| 2,151,208 | 3/1939 | Hinlker | 24/263 |
| 2,189,244 | 2/1940 | Gilbert | 188/67 |
| 2,245,592 | 6/1941 | Jones | 24/263 |
| 2,340,597 | 2/1944 | Kelley | 24/263 |
| 2,570,039 | 10/1951 | Stone | 24/263 |
| 2,607,098 | 8/1952 | Wilson | 24/263 |
| 2,641,816 | 6/1953 | Liljestrand | 24/263 |
| 2,662,737 | 12/1953 | Edelberg | 255/23 |
| 2,939,683 | 6/1960 | Spiri | 255/23 |
| 3,210,821 | 10/1965 | Spiri et al. | 24/263 |
| 3,270,389 | 9/1966 | Kingsbury | 24/263 |
| 3,422,506 | 1/1969 | Turner | 24/263 CA |
| 3,457,605 | 7/1969 | Kingsbury et al. | 24/263 |
| 3,571,865 | 3/1971 | Johnson | 24/263 |
| 3,742,562 | 7/1973 | Haby | 24/263 |
| 3,961,399 | 6/1976 | Boxadjieff | 24/263 DG |

*Primary Examiner*—Kenneth Dorner
*Attorney, Agent, or Firm*—William P. Green

[57] ABSTRACT

A slip assembly for supporting well pipe in a rotary table and including a slip bowl structure to be received and supported within the rotary table in a relation to turn with it, a carrier structure supporting a plurality of slips and mounted for upward and downward movement relative to the slip bowl structure and with the slips, latch means for releasably retaining the carrier structure and slips in a lower active pipe gripping position, and yielding means urging the carrier structure and slips upwardly to retracted positions when the latch means are released.

32 Claims, 6 Drawing Figures

FIG. 4
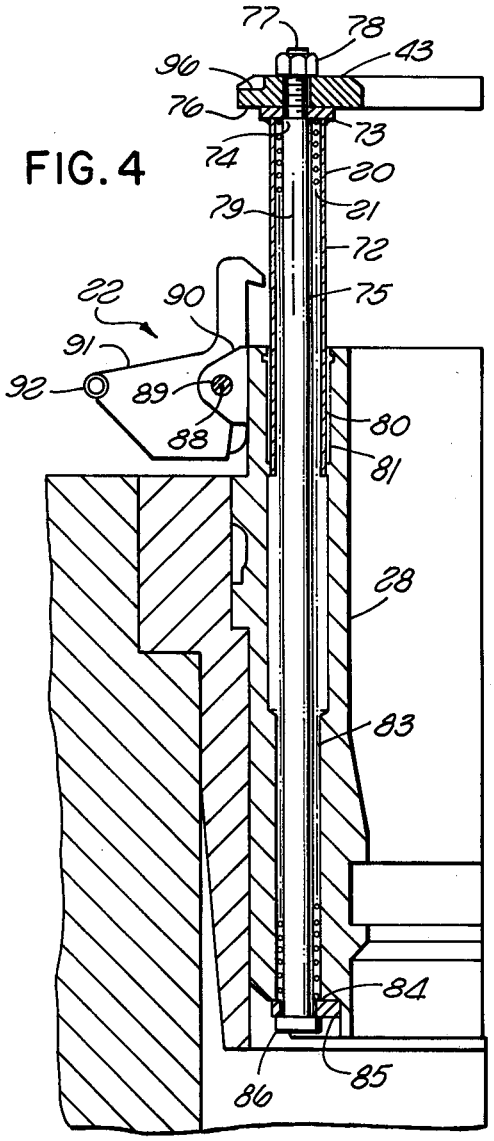
FIG. 5
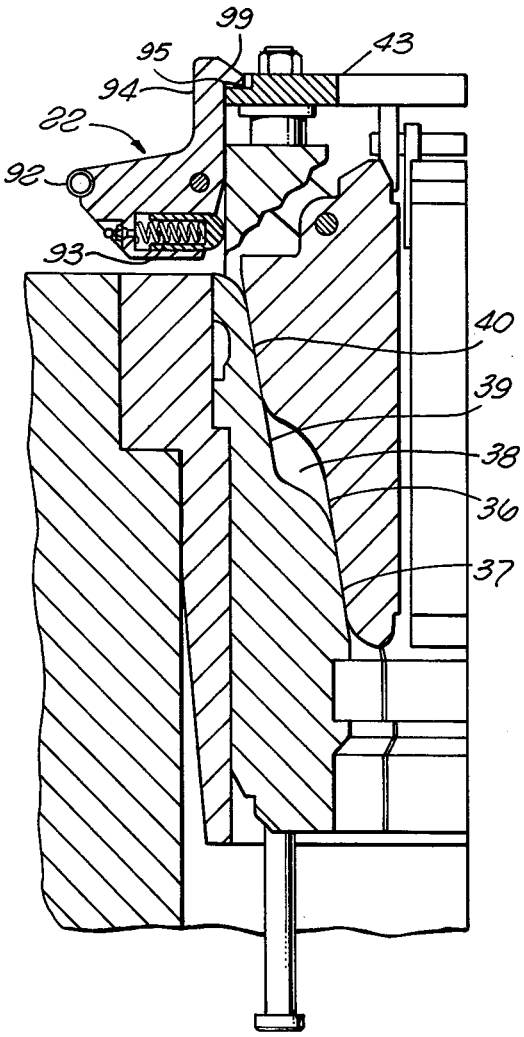
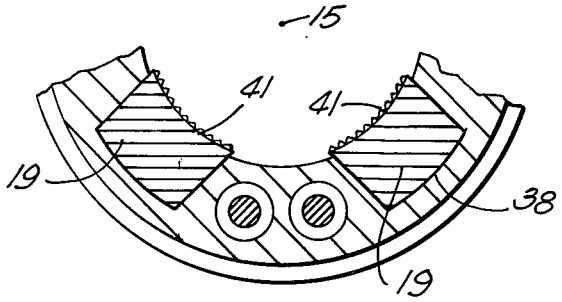
FIG. 6

SLIP ASSEMBLY

This is a continuation of application Ser. No. 877,309, filed Feb. 13, 1978, abandoned.

BACKGROUND OF THE INVENTION

This invention relates to improved slip assemblies for supporting a well pipe in a rotary table.

Each time that a length of pipe is added to or removed from a drill string, the string must be temporarily supported by slips positioned within a tapered slip bowl structure in a rotary table. After the desired length of pipe has been added or removed, the slips are released to permit vertical movement of the string. On occasions when the entire string must be removed from the well, as for replacement of a bit or for other similar purposes, the necessity for repeated movement of the slips into and out of active position in first successively breaking a large number of connections in the string as it is removed from the well, and then remaking these connections when the string is again lowered into the well, results in the expenditure of a great deal of time and effort just in slip handling. Where the slips are handled entirely manually, their usually very substantial weight renders it rather difficult for the workmen to lift the slips into and out of the bowl, and there is also an ever present danger of injury in such handling of the slips.

In an attempt to overcome these difficulties, various types of power slip arrangements have been proposed in the past, in which a power operated unit has been employed to suspend the slips above the slip bowl, and in some way utilize power for effecting at least a portion of the slip movement. For example, such power slip arrangements have been shown in U.S. Pat. Nos. 2,939,683, 3,210,821, 3,270,389, 3,457,605, 3,961,399, 2,570,039 and 2,641,816. Some of these have been effective in operation, and have seen substantial use, but many drilling companies have continued to use manual slips because of the high cost of power slip units, and because most power slip units require permanent attachment of a support post or other structure to the rig floor at the side of the rotary table. Space is at a premium on the rig floor, and many drillers hesitate to occupy a portion of that space permanently by equipment which during much of the time will not be in use and may interfere with other operations.

U.S. Pat. No. 2,607,098 shows a slip arrangement in which a plurality of slips are supported by a slip bowl structure for relative upward and downward movement, and can be releasably supported in an upper inactive position. U.S. Pat. No. 2,340,597 shows a device in which an actuating mechanism manually operable from a side of the well pipe can move a slip carrier upwardly and downwardly relative to a slip bowl. U.S. Pat. Nos. 2,151,208, 2,245,592 and 3,742,562 show well pipe supporting 'spiders', which include vertically movable slips, but which are not capable of rotating with the pipe as is desirable in a rotary table arangement of the type with which the present invention is concerned. The first of these three patents, U.S. Pat. No. 2,151,208 shows a spider body having slips which are actuable upwardly and downwardly by a pivoting lever, with a spring urging the slips downwardly to their active position and a latch being operable to hold the lever in its retracted condition.

SUMMARY OF THE INVENTION

The present invention provides a unique slip assembly adapted to be supported by and turn with a rotary table, and which is constructed to greatly facilitate and simplify handling of slips as compared with a completely manual operation, and at the same time avoids the disadvantages of a powered arrangement. The assembly may be left in position on the rotary table during an entire 'round trip' of the string out of and then back into the pipe, and can be quickly and easily actuated between pipe supporting and pipe releasing positions when each connection is to be made or broken. When the slips are in their inactive positions, they are far enough from the axis of the pipe to permit the enlarged tool joints to pass through the slip assembly without any difficulty. In addition, the assembly does not require mounting of a support post or other structure to the rig floor, but leaves the entire floor area uncluttered insofar as the slip assembly is concerned. The simplicity of the arrangement allows it to be manufactured and sold at a very low cost as compared with power type slip handling equipment.

In a unit embodying the invention, the slips are supported by a carrier structure which is mounted for upward and downward movement relative to the slip bowl structure, and which can be releasably retained by latch means in a lower active pipe gripping position of the slips. In conjunction with the latch means, the device includes yielding means which urge the carrier structure and slips upwardly and act to return them to an upper retracted position when the latch means are released. The yielding means desirably include one or more springs, preferably a plurality of circularly spaced coil springs acting upwardly against the carrier structure. These springs may be located within a plurality of mounting post assemblies which support the carrier structure for its upward and downward movement.

The latch means preferably include a latch part which is engageable with a shoulder formed on the carrier structure when the latter is in its lower active position. The carrier structure may be constructed to have a portion or portions on which one or more workmen may stand, so that the carrier structure and slips may be actuated downwardly against the spring force by the weight of the workmen. For this purpose, the carrier structure may have an outer ring portion extending about the pipe, which desirably has an interruption at one location, with the latch part being positioned in this interruption and adapted to be released by downward actuation.

BRIEF DESCRIPTION OF THE DRAWINGS

The above and other features and objects of the invention will be better understood from the following detailed description of the typical embodiment illustrated in the accompanying drawings, in which:

FIG. 4 is a fragmentary vertical section taken on line 4—4 of FIG. 2;

FIG. 5 is a fragmentary sectional view taken on line 5—5 of FIG. 2, and showing the slips latched in their lower active positions; and FIG. 6 is a fragmentary horizontal section taken on line 6—6 of FIG. 3.

DESCRIPTION OF THE PREFERRED EMBODIMENT

Figure 1:
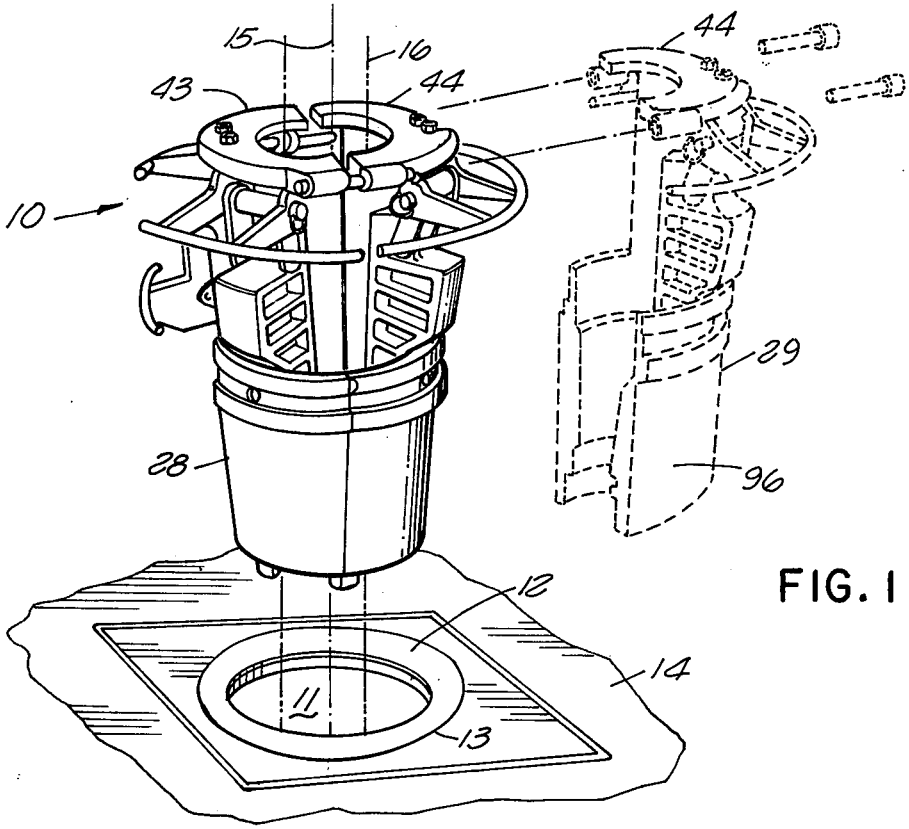
FIG. 1 is a perspective view of a slip assembly constructed in accordance with the invention, with an indication in broken lines of the manner in which the two halves of the device may be separated for placement about a drill pipe.
Figure 3:
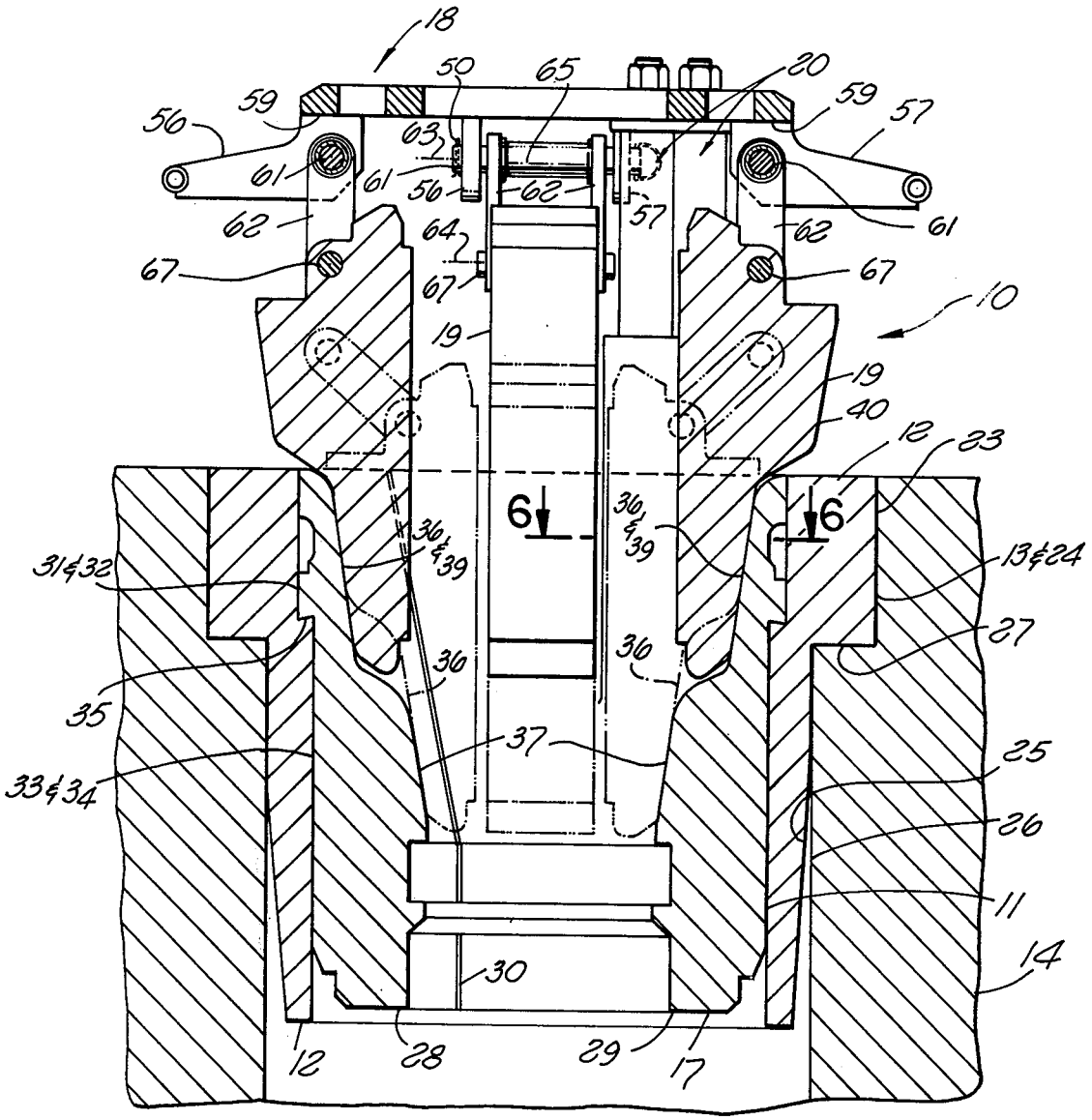
FIG. 3 is a vertical section taken on line 3—3 of FIG. 2, and showing the device positioned within a conventional master bushing in a rotary table.

FIG. 1 illustrates generally at 10 a slip assembly embodying the present invention, shown positioned above an opening 11 in a conventional well drilling master bushing 12 positioned within an opening 13 in a rotary table 14 which turns about the vertical axis 15 of a well. The well pipe is illustrated at 16. In use, the slip assembly 10 is moved downwardly from the position illustrated in FIG. 1 to a position in which a lower slip bowl structure or portion 17 of assembly 10 is received and supported within opening 11 in the master bushing. FIG. 3 illustrates the assembly in that active position within the master bushing and rotary table.

Mounted movably to the slip bowl structure 17 is an upper slip carrier or top plate 18, from which a plurality of (desirably four) slips 19 are suspended, for upward and downward movement with the carrier and relative to slip bowl structure 17. The carrier is guided for this movement by four spaced vertical guide assemblies 20, each containing a coil spring 21 which yieldingly urges carrier 18 and the slips upwardly to their inactive positions of FIGS. 1 and 3. The carrier and slips can be releasably retained in lowered active positions (FIG. 5) by a latch element 22.

As seen in FIG. 3, the conventional master bushing 12 may have an upper externally square portion 23 received in rotary driving relation within an upper internally square portion 24 of the recess 13 in the rotary table 14, with a reduced diameter circular portion 25 of the master bushing being received within a reduced diameter cylindrical bore 26 in the rotary table, to support the master bushing from the rotary table by horizontal shoulders 27. The slip bowl structure 17 of the present device may be formed of two similar semi-circular sections or halves 28 and 29, meeting in a vertical plane 30 (FIG. 3). Externally, these semi-circular sections 28 and 29 have upper enlarged diameter essentially cylindrical portions 31 received within an upper enlarged diameter cylindrical portion 32 of the opening 11 through the master bushing, with reduced diameter complementary external cylindrical surfaces 33 on the slip bowl segments 28 and 29 being received and confined within a lower reduced cylindrical portion 34 of the master bushing, so that the slip bowl assembly is effectively supported in the master bushing by horizontal shoulders at 35. Internally, the slip bowl segments have at a location spaced beneath the tops of the segments two complementary semi-circularly downwardly tapering frustoconical cam surfaces 36 which in the lowered active position of the slips (broken lines in FIG. 3 and full lines in FIG. 5) engage correspondingly downwardly tapered external surfaces 37 formed on slips 19. Above the level of surfaces of 36, each of the slip bowl segments 28 and 29 contains two circularly spaced enlarged diameter recesses 38 having outer walls 39 tapering downwardly and frustoconically in correspondence with surfaces 36 and 37 and engageable with upper enlarged diameter similarly tapered cam surfaces 40 on the slips. As seen in FIG. 6, each of the slips has a circular extent corresponding closely to that of the mating recess 38, to be confined closely therein in a manner transmitting rotary motion about axis 15 from the slip bowl to the slips. In the upper inactive position of the slips (full lines in FIG. 3), the larger diameter surfaces 40 of the slips move upwardly beyond the top of the slip bowl segments, and the lower reduced diameter portions of the slips move into recesses 38, so that the slips can move radially outwardly to positions spaced relatively far from the outer surface of pipe 16. Internally, the slips 19 have inner surfaces 41, which extend essentially cylindrically at the same diameter as the outer surface of pipe 16, to grip and support that pipe, and which desirably have teeth as shown for assuring effective gripping engagement with the pipe.

Figure 2:
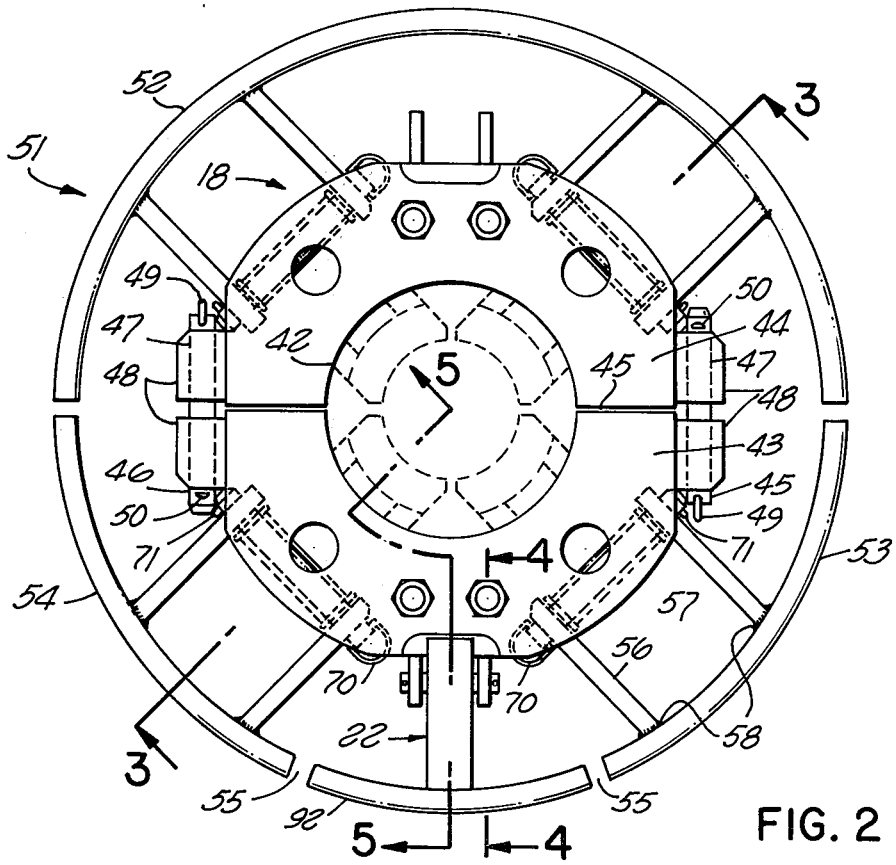
FIG. 2 is an enlarged top plan view of the FIG. 1 device.

The slip carrier structure 18 may take the form essentially of a horizontally extending plate-like structure, containing a central circular opening 42 (FIG. 2) through which the well pipe extends vertically. Carrier 18 is preferably formed of two complementary essentially semi-circular sections or halves 43 and 44, meeting or essentially meeting at surfaces 45 lying in the previously mentioned plane of separation 30 of the two slip bowl segments 28 and 29. These two sections 43 and 44 of the top carrier 18 may be detachably but rigidly secured together by two horizontal parallel connector pins 45 and 46 received and closely confined within aligned passages 47 in lugs 48 at the ends of the carrier sections 43 and 44. Handle loops 49 connected to first ends of the pins 45 and 46 facilitate insertion and removal of the pins and prevent axial movement in one direction, while cotter keys 50 or the like extending through opposite ends of the pins can releasably retain them against removal in the opposite direction.

The top plate or carrier structure 18 rigidly carries an actuating ring 51, which extends circularly about axis 15 at a location spaced radially outwardly from plate 18. This ring 51 may be formed from rigid metal rod of an appropriate diameter, and may be constructed sectionally so that different portions of the ring may separate from one another in the same plane 30 as do the other previously mentioned parts. More particularly, a first semi-circular section 52 of ring 51 may be attached rigidly to section 44 of the top carrier plate, while two additional sections 53 and 54 may be carried by the second plate 43, with an interruption in the ring being formed at 55 between the two sections 53 and 54. All of these sections 52, 53 and 54 may be connected to the top plate sections 43 and 44 in any appropriate manner, desirably by provision at the location of each of the slips 19 of two parallel mounting or connector parts 56 and 57 having radially outer ends welded at 58 to the corresponding ring segment, and having inner ends welded at 59 to the underside of the corresponding plate 43 or 44. Directly beneath plate 43 or 44, each of these pairs of mounting elements 56 and 57 may contain horizontally aligned apertures 60 through which a horizontal pin 61 extends for pivotally attaching a corresponding slip suspending link unit 62 from the top plate. One such link is provided at the location of each of the slips, and is connected at its upper end to the carrier structure 18 for relative pivotal movement about a horizontal axis 63, and at its lower end to a corresponding one of the slips 19 for relative pivotal movement about a second horizontal axis 64 extending parallel to axis 63. As will be understood, these axes 63 and 64 are so disposed as to be tangent to circles centered about well axis 15, and are oriented to allow the slips to swing inwardly and outwardly relative to axis 15 as they move between the upper retracted positions of the slips and the lower active position of the slips. To form the two pivot connections, each link unit 62 is received about the corresponding pin 61 at a location between two of the connector members 56 and 57, and may include a tube 65 fitting closely about that pin and welded at its opposite ends to two parallel downwardly projecting arms 66 pivotally connected at their lower ends to the associated slip 19 by a pin 67. Each of the pins 61 may have a handle loop 70 at one end and an aperture through which a cotter key 71 or the like may extend at the opposite end of the pin, to retain the pin in its active position but permit detachment of the slips when desired.

Each of the top plate sections 43 and 44 is connected movably to the corresponding slip bowl segment 28 or 29 by two of the previously mentioned vertically extending guide or connector units 20. As seen in FIG. 4, each of these connector units 20 includes an externally cylindrical vertical tube 72 which is rigidly attached to the corresponding top plate section 43 or 44, as by welding a horizontal disc 73 to the upper end of the tube and then clamping that disc to the underside of plate 43 or 44 between a shoulder 74 on a vertical rod 75 and the undersurface 76 of the plate. A reduced diameter shank 77 of rod 75 extends upwardly through apertures in disc 73 and plate 43 or 44, for connection at its upper threaded end to a nut 78 acting to clamp the parts together. Tube 72 and rod 75 are in each case concentric about an individual axis 79 of that particular guide unit, and both project downwardly within a vertical cylindrical bore 80 in the corresponding slip bowl segment 28 or 29. A cylindrical shouldered bushing 81 retained within the upper portion of bore 80 slidably and telescopically interfits with tube 72, to effectively guide the tube and top plate 43 or 44 for only directly vertical movement relative to the upper slip bowl structure. The tube 72 and connected top plate are yieldingly urged upwardly by a vertical coil spring 21 which is received radially between tube 72 and rod 75, and which extends downwardly beyond the lower end of tube 72 and through a reduced diameter extension 83 of bore 80. At its lower end, spring 21 may bear downwardly at 84 against a bottom plate 85 secured to the underside of the slip bowl segment by upward engagement of a head 86 on rod 75 with plate 85. The upper enlarged diameter portion 80 of the bore is of course long enough to receive tube 72 in the lower active position of the slips. The four coil springs 21 together have enough strength to very substantially overcome the weight of the carrier structure 18 and all of the connected slips and other parts, and thus normally maintain the carrier structure and slips in their upper full line retracted positions of FIG. 3. This spring force may be overcome by pressing downwardly against the ring structure 51. Preferably, the downward force thus required to overcome the springs is relatively great to assure against accidental downward actuation of the slips, and for this purpose the required force to overcome the springs, over and above the force of gravity resulting from the weight of the carrier and connected parts, is desirably at least about 100 pounds, and for best results approximately 400 pounds. This downward force may then be exerted by one or more workmen standing on the ring structure 51, so that the weight of the workmen will move the carrier and slips downwardly.

The latch element 22 for retaining the slips in their lowered active positions may have the configuration illustrated in FIG. 4, and be pivoted to the slip bowl segment 28 for relative pivotal movement about a horizontal axis 88, as by extension of a pivot pin 89 through element 22 and a pair of mounting lugs 90 projecting outwardly from section 28. An actuating arm 91 of element 22 projects radially outwardly and may carry an arcuately curved rod 92 received at the location of the previously mentioned interruption 55 in ring structure 51, and forming in effect a continuation of that ring structure in the lower active position of the slips. A spring 93 received within a cavity in element 22 (FIG. 5) yieldingly urges a pin 193 against the outer surface of the slip bowl section 28, to yieldingly resist pivotal movement of element 22 in a counter-clockwise direction as viewed in FIGS. 4 and 5. An upwardly projecting portion 94 of element 22 has an inwardly projecting hook portion with a downwardly facing shoulder 95, desirably inclined slightly as shown, which in the FIG. 5 latched condition of the parts engages an upwardly facing, preferably directly horizontal latching shoulder 96 on top plate 43 to positively but releasably lock the carrier structure and slips in the lowered active position of FIG. 5. The latch may be released by downward deflection of actuating ring segment 92, which may be foot operated downwardly by a workman.

To describe a cycle of operation of the device, assume that a drill pipe 16 is already located in a position of vertical extension through the rotary table and master bushing 12, and that it is desired to utilize the device 10 for supporting the string while a length of pipe is removed from the string. The two halves of the device 10 may initially be separated from one another, as represented in FIG. 1 in which one of the separated halves is represented in broken lines at 196. Each of these halves includes a lower slip bowl segment 28 or 29 and an upper spring urged carrier plate half 43 or 44 with a connected ring element 52 or elements 53 and 54, and with the movably suspended slips, and further with the latch element 22 being carried by one of the halves. The two halves are moved separately to positions about the pipe, and are then secured together by insertion of the two connector pins 45 and 46 into the two top plates. The top plates then form together a single rigid carrier structure by which all of the other elements are carried in the relationship illustrated in full lines in FIG. 1. In this condition, the slip bowl structure 17 is lowered into the opening 11 in the master bushing, to a position of support thereby. The coil springs 82 normally retain the slip carrier and attached slips in their upper retracted positions, in which the pipe 16 can be moved freely upwardly and downwardly without interference by the slips, and with the opening through the device 10 being large enough to pass enlarged joints of the drill pipe. When it is desired to support the drill string in the rotary table by means of the unit 10, the workmen press downwardly on the ring structure 51, desirably by stepping on that ring at different locations about the pipe, as represented at 97 in FIG. 3. The combined weight of the workmen thus presses the carrier and slips downwardly to the FIG. 5 position, causing an edge 98 of top plate 18 to engage cam surface 99 of latch element 22 in a manner first deflecting the upper portion of the latch element outwardly and then permitting it to return inwardly to its FIG. 5 latching condition. In this condition, the inner gripping surfaces of the four slips are in simultaneous gripping contact with the outer surface of the well pipe, so that when the pipe is then released for downward movement the slips will be wedged more tightly downwardly and inwardly against the pipe to effectively support its entire weight. It is also noted that in this condition of the apparatus the entire unit 10 can turn with the rotary table 14 and master bushing 13, so that rotation of the table and contained unit 10 can be employed for turning the suspended pipe to make or break a joint. When it is desired to again move the pipe 16 vertically, an operator presses downwardly with his hand or foot on the actuating portion 92 of the latch element, to release the latch and permit upward movement of the carrier and slips by the force of coil springs 82.

While a certain specific embodiment of the present invention has been disclosed as typical, the invention is of course not limited to this particular form, but rather is applicable broadly to all such variations as fall within the scope of the appended claims.

We claim:

1. A slip assembly comprising:

a slip bowl structure adapted to be received and supported within an opening in a well drilling rotary table in a relation to turn with the table;

a carrier structure mounted to said bowl structure for upward and downward movement relative thereto;

a plurality of slips which have inner faces for gripping a well pipe and which are connected to said carrier structure for movement upwardly and downwardly therewith relative to said bowl structure between lower active positions and upper retracted positions;

said bowl structure and said slips having engaging wedge surfaces acting to cam the slips inwardly into tight gripping engagement with a well pipe upon downward movement of the slips to said active positions;

latch means for releasably retaining said carrier structure and slips in said lower active positions; and yielding means urging said carrier structure and slips upwardly and acting to return them to said upper retracted positions when said latch means are released.

2. A slip assembly as recited in claim 1, in which said carrier structure has a portion or portions on which one or more workmen may stand in a relation to actuate the carrier structure and connected slips downwardly by the weight of the workmen.

3. A slip assembly as recited in claim 1, in which said carrier structure has an actuating ring extending essentially about the well pipe and on which one or more workmen can stand in a relation to actuate the carrier structure and slips downwardly by the weight of the workmen.

4. A slip assembly as recited in claim 1, in which said carrier structure includes a plurality of complementary sections to be received at different locations about the well pipe and which are relatively openable to permit the sections to be moved laterally onto and off of the pipe.

5. A slip assembly as recited in claim 1, in which said slip bowl structure has an upper external flange receivable within an upper counterbore in a well drilling master bushing assembly, and has a lower reduced diameter externally essentially cylindrical portion receivable within a lower reduced diameter portion of the master bushing.

6. A slip assembly as recited in claim 1, in which said slip bowl structure is formed of a plurality of complementary sections receivable at different locations about the well pipe.

7. A slip assembly as recited in claim 1, in which said carrier structure includes a plurality of complementary sections received at different sides of the well pipe and separable from one another for removal from about the pipe, and connector means detachably securing said sections of the carrier structure together.

8. A slip assembly as recited in claim 1, in which said carrier structure includes two complementary essentially semi-circular sections extending about the well pipe, and connector pins extending through registering apertures in said sections at diametrically opposite locations and securing them detachably together.

9. A slip assembly as recited in claim 1, including means guiding said carrier structure for only said upward and downward movement relative to said slip bowl structure.

10. A slip assembly as recited in claim 1, including telescopically interfitting connector parts attaching said carrier structure to said slip bowl structure for said relative upward and downward movement.

11. A slip assembly as recited in claim 1, in which said slip bowl structure contains a plurality of circularly spaced vertically extending guide passages, said carrier structure having a plurality of circularly spaced guide elements extending downwardly into said passages respectively and guided thereby for vertical movement to guide said carrier structure for its upward and downward movement relative to the bowl structure.

12. A slip assembly as recited in claim 1, in which said bowl structure contains a plurality of circularly spaced essentially cylindrical bores, said carrier structure having a plurality of circularly spaced vertical tubes projecting downwardly into said bores and guided for vertical sliding movement relative thereto, and a plurality of circularly spaced guide rods projecting downwardly within said tubes in spaced relation thereto and retaining said structures against vertical separation.

13. A slip assembly as recited in claim 1, in which said yielding means are spring means yieldingly urging said carrier structure upwardly and said slip bowl structure downwardly.

14. A slip assembly as recited in claim 1, in which said yielding means include a coil spring acting upwardly against said carrier structure and downwardly against said slip bowl structure.

15. A slip assembly as recited in claim 1, in which said yielding means include a plurality of circularly spaced coil springs interposed operatively between said structures.

16. A slip assembly as recited in claim 1, including two telescopically interfitting tubular parts connecting said carrier structure to said slip bowl structure for said relative vertical movement, said yielding means including a coil spring extending vertically within said tubular parts.

17. A slip assembly as recited in claim 1, in which said slip bowl structure includes a plurality of circularly spaced vertical bores, said carrier structure having a plurality of downwardly projecting tubes slidably received within said bores to guide the carrier structure for its upward and downward movement, said yielding means including a plurality of circularly spaced vertical coil springs received within said bores and said tubes, and there being a plurality of vertical rods within said coil springs retaining said structures against vertical separation.

18. A slip assembly as recited in claim 1, in which said latch means have an actuating portion operable to release the latch means by exertion of downward force against said operating portion.

19. A slip assembly as recited in claim 1, in which said carrier structure has an actuating portion extending essentially about the well pipe and against which a workman may exert downward force and having an interruption at one location, said latch means having an actuating portion against which a workman may exert releasing force and which is located at said interruption in said actuating portion of the carrier structure.

20. A slip assembly as recited in claim 1, in which said carrier structure has an actuating ring extending essentially circularly about the well pipe and having an interruption at one side of the pipe and against which one or more workmen may exert downward force to actuate the carrier structure to active position; said latch means having an actuating portion operable by downward movement to release the latch means and forming essentially a continuation of said ring at said interruption.

21. A slip assembly as recited in claim 1, in which said carrier structure has an actuating ring extending essentially circularly about the well pipe and having an interruption at one side of the pipe and against which one or more workmen may exert downward force to actuate the carrier structure to active position; said latch means including a latch element pivotally mounted to said bowl structure and engageable in latching relation with a shoulder on said carrier structure and having an actuating portion which projects outwardly and acts upon downward movement to release the latch part and which forms essentially a continuation of said ring at said interruption, there being a spring yieldingly resisting releasing movement of said latch part.

22. A slip assembly as recited in claim 21, including a plurality of connections between said slip bowl structure and carrier structure at circularly spaced locations each including telescopically vertically interfitting portions of said carrier structure and slip bowl structure guiding the carrier structure for said upward and downward movement, said yielding means including a plurality of vertical coil springs received within said telescopically interfitting portions of the structures.

23. A slip assembly comprising:

a support structure adapted to be supported on a well drilling rotary table in a relation to turn with the table;

a carrier structure mounted to said support structure for upward and downward movement relative thereto;

a plurality of slips which have inner faces for gripping a well pipe and which are connected to said carrier structure for movement upwardly and downwardly therewith relative to said support structure between lower active positions and upper retracted positions;

said slips having outer wedge surfaces for camming the slips inwardly into tight gripping engagement with a well pipe upon downward movement of the slips to said active positions;

latch means for releasably retaining said carrier structure and slips in said lower active positions; and yielding means urging said carrier structure and slips upwardly and acting to return them to said upper retracted positions when said latch means are released.

24. A slip assembly as recited in claim 23, in which said carrier structure has a portion or portions on which one or more workmen may stand in a relation to actuate the carrier structure and connected slips downwardly by the weight of the workmen.

25. A slip assembly as recited in claim 23, in which said carrier structure includes a plurality of complementary sections to be received at different locations about the well pipe and which are relatively openable to permit the sections to be moved laterally onto and off of the pipe.

26. A slip assembly as recited in claim 23, in which said support structure is formed of a plurality of complementary sections receivable at different locations about the well pipe.

27. A slip assembly as recited in claim 23, including telescopically interfitting connector parts attaching said carrier structure to said support structure for said relative upward and downward movement.

28. A slip assembly as recited in claim 23, in which said support structure contains a plurality of circularly spaced essentially cylindrical bores, said carrier structure having a plurality of circularly spaced vertical tubes projecting downwardly into said bores and guided for vertical sliding movement relative thereto, and a plurality of circularly spaced guide rods projecting downwardly within said tubes in spaced relation thereto and retaining said structures against vertical separation.

29. A slip assembly as recited in claim 23, in which said support structure includes a plurality of circularly spaced vertical bores, said carrier structure having a plurality of downwardly projecting tubes slidably received within said bores to guide the carrier structure for its upward and downward movement, said yielding means including a plurality of circularly spaced vertical coil springs received within said bores and said tubes, and there being a plurality of vertical rods within said coil springs retaining said structures against vertical separation.

30. A slip assembly as recited in claim 23, in which said latch means have an actuating portion operable to release the latch means by exertion of downward force against said actuating portion.

31. A slip assembly as recited in claim 23, in which said carrier structure has an actuating portion extending essentially about the well pipe and against which a workman may exert downward force and having an interruption at one location, said latch means having an actuating portion against which a workman may exert releasing force and which is located at said interruption in said actuating portion of the carrier structure.

32. A slip assembly as recited in claim 23, in which said carrier structure has an actuating ring extending essentially circularly about the well pipe and having an interruption at the one side of the pipe and against which one or more workmen may exert downward force to actuate the carrier structure to active position; said latch means including a latch element pivotally mounted to said support structure and engageable in latching relation with a shoulder on said carrier structure and having an actuating portion which projects outwardly and acts upon downward movement to release the latch part and which forms essentially a continuation of said ring at said interruption, there being a spring yieldingly resisting releasing movement of said latch part.

* * * * *